US006567529B1

(12) United States Patent
Roark

(10) Patent No.: US 6,567,529 B1
(45) Date of Patent: May 20, 2003

(54) LOW FREQUENCY LOUDSPEAKER DRIVER HAVING A POLYGONAL DIAPHRAGM AND METHOD FOR MOUNTING DRIVERS IN A TIGHTLY PACKED TWO-DIMENSIONAL ARRAY

(75) Inventor: Richard S. Roark, Clarksville, TN (US)

(73) Assignee: Mitek Corporation, Winslow, IL (US)

( * ) Notice: Subject to any disclaimer, the term of this patent is extended or adjusted under 35 U.S.C. 154(b) by 0 days.

(21) Appl. No.: 10/036,007

(22) Filed: Dec. 28, 2001

Related U.S. Application Data

(60) Provisional application No. 60/259,409, filed on Dec. 29, 2000.

(51) Int. Cl.[7] ..... H04R 1/00
(52) U.S. Cl. ..... 381/423; 381/433
(58) Field of Search ..... 381/423, 424, 381/430, 432, 433; 181/173, 174, 164

(56) References Cited

U.S. PATENT DOCUMENTS 1,829,355 A * 10/1931 Houghton
2,890,760 A * 6/1959 Bobb
4,107,479 A * 8/1978 Heil
4,434,203 A * 2/1984 Briefer
4,673,057 A * 6/1987 Glassco
4,881,617 A * 11/1989 Faraone
6,134,337 A * 10/2000 Isaka

* cited by examiner

*Primary Examiner*—Sinh Tran
(74) *Attorney, Agent, or Firm*—J. Andrew McKinney, Jr.

(57) ABSTRACT

A low frequency loudspeaker driver has polygonal diaphragm surfaces. In a first embodiment, the peripheral edge of a loudspeaker driver diaphragm is polygonal, preferably hexagonal or six sided, wherein each of the six peripheral sides are of equal length and meet in radiused or rounded corners. The hexagonal loudspeaker driver is supported within a matching hexagonal section truncated pyramid shaped basket having a hexagonal peripheral mounting flange. The hexagonal woofer of a first embodiment is adapted to be mounted on a planar baffle in a variety of densely packed arrays such that virtually no wasted baffle space is visible between the driver basket peripheral edges. The faceted hexagonal diaphragm shape provides an increase in cone surface area of approximately ten percent as compared to conventional frustoconical woofers having circular peripheral edges.

13 Claims, 9 Drawing Sheets

LOW FREQUENCY LOUDSPEAKER DRIVER HAVING A POLYGONAL DIAPHRAGM AND METHOD FOR MOUNTING DRIVERS IN A TIGHTLY PACKED TWO-DIMENSIONAL ARRAY

RELATED APPLICATION INFORMATION

This application is a continuation of U.S. provisional application serial No. 60/259,409, filed Dec. 29, 2000, the entire disclosure of which is incorporated herein by reference.

BACKGROUND OF THE INVENTION

1. Field of the Invention

The present invention relates to instruments for sound reproduction, and more particularly, to low frequency loudspeaker drivers, conventionally referred to as Woofers.

2. Discussion of the Prior Art

A great variety of moving coil loudspeaker designs have been proposed for high quality low frequency sound reproduction, and many have gone into commercial use. These are typically included in a modern full range loudspeaker system utilizing different speakers for different segments of the sound spectrum. For example, a "woofer" is used for bass or low frequencies, a "mid-range" is used for intermediate frequencies and a "tweeter" is used for the highest frequencies in the reproduced spectrum.

It is generally accepted that loudspeakers with sufficient size to produce adequate bass have well understood limitations. In particular, break-up of the cone motion into standing waves, beaming and other directional effects cause poor sound reproduction when driven by more challenging audio signals.

Typical prior art woofers utilize frustoconical baskets supporting frustoconical driver diaphragms, each having a circular peripheral edge. Customarily, the circular small end of the frustoconical diaphragm supports an axially aligned cylindrical voice coil former which carries a conductive voice coil having positive and negative terminal ends. Conventional woofers utilize baskets which closely follow the frustoconical shape of the driver diaphragm and support an axially aligned motor magnet and the circular diaphragm surround in a co-axial alignment, permitting the axial oscillating movement of the diaphragm in response to excitation of the voice coil.

In some high-end automotive or "twelve volt" applications, music aficionados and auto-sound competitors will install several woofers in a two-dimensional array on a baffle or enclosure surface; for example, it may be desirable to install five woofers in two rows, with a row having two woofers juxtaposed with a second row having three woofers. When installers attempt to install as many conventional woofers as possible in a baffle, there are, necessarily, three-point star-shaped baffle surface spaces left uncovered between the adjoining woofer baskets. The ideal installation, from an afficionado's or competitor's viewpoint, is one having the entire baffle covered with woofer diaphragms. The uncovered baffle spaces leave the consumer with the impression of wasted space.

Another concern for music afficionados and auto-sound competitors is woofer failure due to thermal or mechanical overloading problems. Substantial amounts of power are required to provide competition-winning sound pressure levels, often well over 150 decibels (dB). Signals having such power require very large current flow through voice coil conductors, thus generating substantial amounts of heat, and drive the woofers to extreme excursions, thus generating extreme mechanical loads on driver diaphragms and suspensions. In order to overcome these perceived difficulties, the inventor has developed a number of new woofer configurations.

OBJECTS AND SUMMARY OF THE INVENTION

Accordingly, it is a primary object of the present invention to overcome the above mentioned difficulties by providing a woofer diaphragm having a polygonal peripheral shape, preferably supported within a basket having a matching polygonal peripheral shape.

Another object of the present invention is to provide a woofer structure having a faceted diaphragm surface with a hexagonal peripheral edge, preferably supported within a basket having a matching hexagonal peripheral shape.

Another object of the present invention is to provide a woofer configuration which permits mounting a plurality of woofers in a two-dimensional planar array having adjoining basket edges which interlock in a pattern that uses substantially all of the baffle surface area.

Yet another object of the present invention is to provide a woofer diaphragm which is free of the traditional standing wave break-up modes associated with traditional frustoconical woofer diaphragm shapes.

The aforesaid objects are achieved individually and in combination, and it is not intended that the present invention be construed as requiring two or more of the objects to be combined unless expressly required by the claims attached hereto.

A low frequency loudspeaker driver has polygonal diaphragm surfaces. In a first embodiment of the present invention, the peripheral edge of a loudspeaker driver diaphragm is polygonal (preferably hexagonal or six sided), wherein each of the six peripheral sides are of equal length and meet in rounded or radiused corners. The hexagonal loudspeaker driver is supported within a matching hexagonal cross-section truncated pyramid shaped basket having a hexagonal peripheral mounting flange.

The hexagonal woofer of the first embodiment is adapted to be mounted on a substantially planar baffle in a variety of densely packed arrays such that virtually no wasted baffle space is visible between the driver basket peripheral edges. The faceted hexagonal diaphragm shape provides an increase in effective cone surface area of approximately ten percent as compared to similarly sized conventional frustoconical woofers having circular peripheral edges.

In one embodiment in accordance with the present invention, a nominally 12 inch hexagonal cone has an outer peripheral edge which is substantially hexagonal but includes a faceted, multi planar diaphragm configuration terminating in a substantially circular voice coil support at the back of the cone. This novel configuration includes a polymer or plastic (e.g., Apical® polymer) voice coil former suspended in an annular gap within the motor structure. The voice coil former supports a long-throw voice coil. The hexagonal driver of the preferred embodiment preferably includes a hexagonal dust cap covering the aperture supporting the voice coil former. The dust cap is comprised of contiguous substantially planarfacets defining six equilateral triangle segments and provides a striking visual effect. Preferably, printed indicia are included on the dust cap to provide the purchaser with an attractive visual presentation.

In an alternative embodiment of the low frequency loudspeaker driver of the present invention, the polygonal configuration of the diaphragm is augmented with rounded or radiused outer segments to provide a circular peripheral edge, thus providing a polygonal faceted diaphragm surface with a circular diaphragm edge. A frustoconical basket having circular inner and peripheral edges supports the circular peripheral edge of a polygonal faceted diaphragm. In an exemplary embodiment, a hexagonal, 6 faceted woofer cone surface supports a hexagonal dust cap. The outer peripheral edge of the diaphragm is circular and a faceted peripheral segment is affixed to an intermediate shoulder having six facets. The intermediate shoulder is terminated at its interior in a polygonal segment which is, in turn, terminated in a small radiused circular opening adapted to support a conventional cylindrical voice coil former. The driver of this embodiment also supports a six facet hexagonal dust cap, preferably bearing a visually striking logo.

Another aspect of the loudspeaker of the present invention is a system of vents arrayed around the spider plateau of the driver motor structure. The vents direct cooling airflow to the voice coil, thereby lowering voice coil temperature during high-power operation. A venting experiment set forth test results from a number of prototypes and the conclusions were used in selecting venting aperture locations. The selected venting aperture configuration comprises six thru holes near the front plate and just under the spider plateau: the six holes are arrayed around the motor sidewall in a circle concentric with the voice coil and are equally spaced. An annular mesh vent screen is aligned with the six holes and filters passing cooling air. The selected venting aperture configuration demonstrated significant voice coil cooling and provided enhanced long-term, high power reliability.

The above and still further objects, features and advantages of the present invention will become apparent upon consideration of the following detailed description of a specific embodiment thereof, particularly when taken in conjunction with the accompanying drawings, wherein like reference numerals in the various figures are utilized to designate like components.

DESCRIPTION OF THE PREFERRED EMBODIMENT

Figure 1:
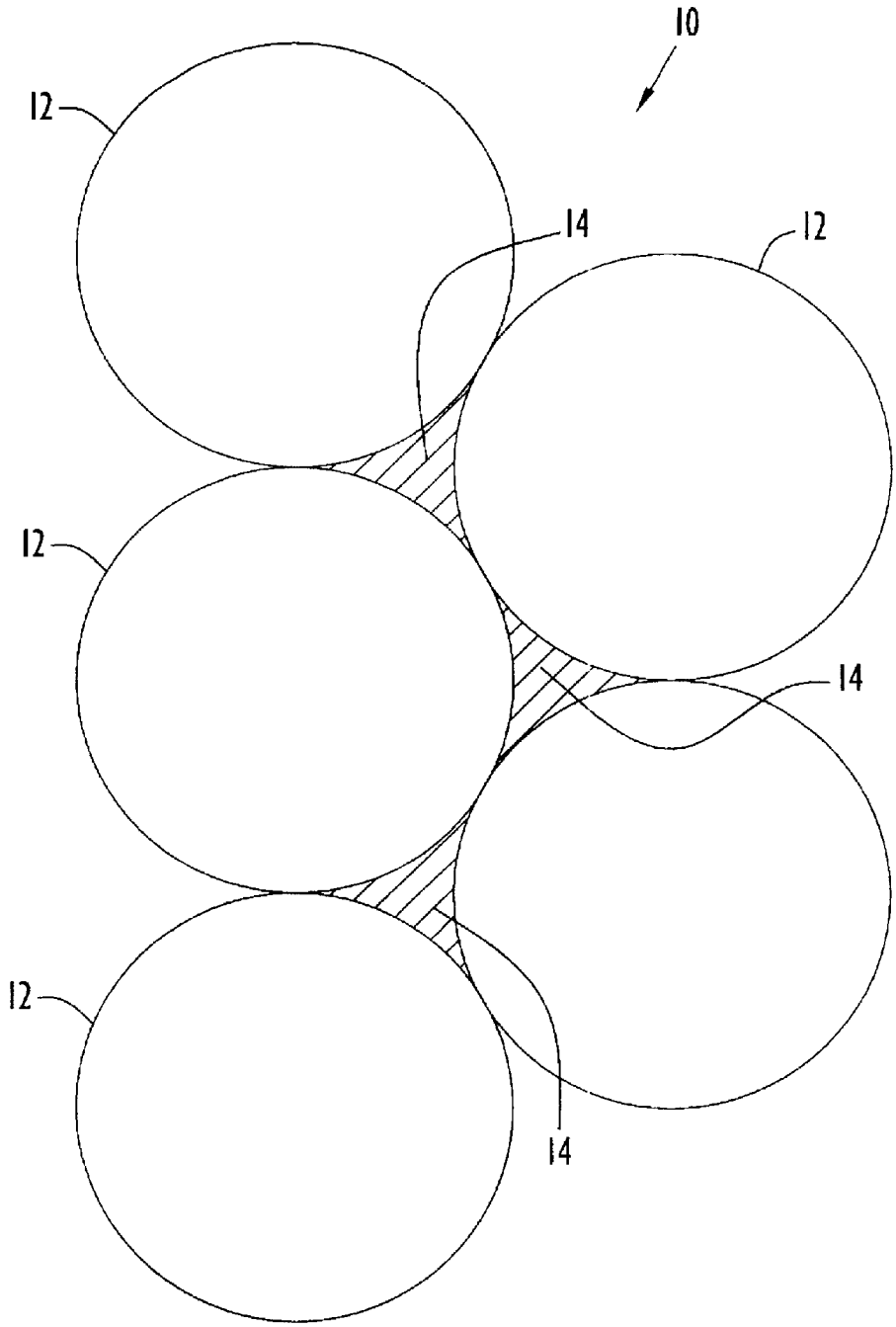
FIG.1 PRIOR ART
FIG. 1 is a plan view of a tightly packed array of conventional circular woofers, in accordance with the prior art.

Referring now to FIG. 1, in the prior art, several woofers 12 are customarily installed in a two-dimensional array 10 on a baffle or enclosure surface. In the illustrated example, five woofers are in two rows. When installers attempt to install as many woofers as possible in a baffle, there are, necessarily, interstitial three-point star shaped baffle surface spaces 14 left uncovered between the woofer baskets (shown shaded). Those uncovered baffle spaces are wasted space that could be covered with diaphragm surface area to good effect.

Figure 2:
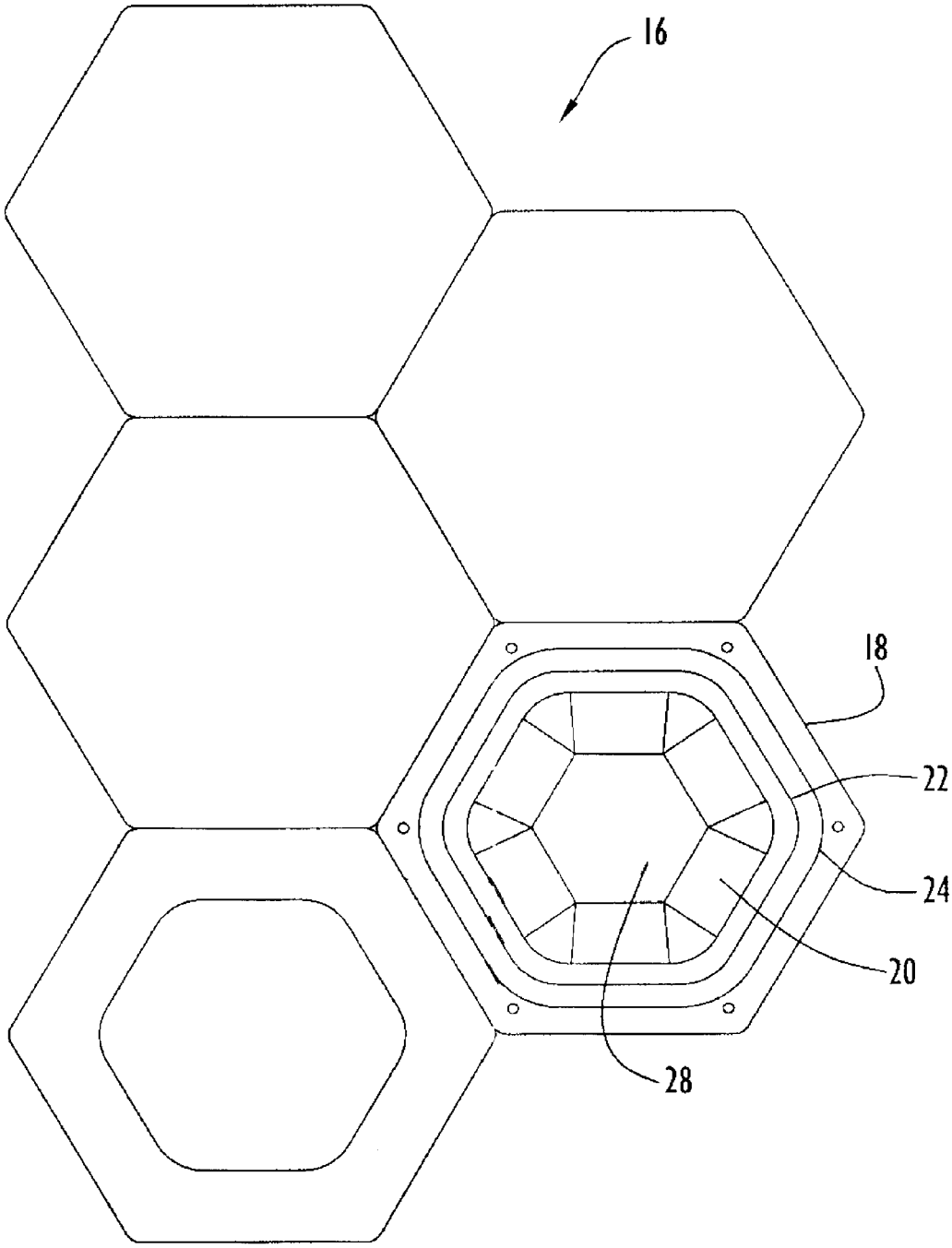
FIG. 2 is a plan view of a tightly packed array of hexagonal woofers, in accordance with the present invention.

The ideal installation, from an afficionado's or competitor's viewpoint, is one having the entire baffle covered with woofer diaphragms. The uncovered baffle spaces add nothing to overall sound pressure level (SPL) generated through the connected audio system (not shown). As shown in FIG. 2, the polygonal (preferably hexagonal) woofer 18 of the present invention may be packed in a tight two dimensional array 16 with essentially no wasted interstitial baffle space, since the hexagonal woofer baskets can be situated proximate one another. In the preferred embodiment of the method of the present invention, a template resembling FIG. 2 (in a 1:1 scale) is provided to simplify layout of the woofers on the baffle. The template preferably includes markings designating where the apertures in the baffle are to be cut for the tightly packed installation, e.g., as shown in FIG. 2.

Low frequency loudspeaker driver or woofer 18 has polygonal, faceted diaphragm surfaces. In the embodiment illustrated in FIGS. 2 through 10, driver 18 has a hexagonal section truncated pyramid shaped diaphragm 20 having a hexagonal peripheral edge 22 wherein each of the six peripheral sides are of equal length and meet in radiused corners 24. The hexagonal loudspeaker driver diaphragm 20 is supported within a matching hexagonal section truncated pyramid shaped basket having a hexagonal peripheral mounting flange 26. The faceted hexagonal diaphragm shape provides an increase in cone surface area of approximately ten percent as compared to the conventional frustoconical woofers having round edges of FIG. 1.

Figure 3:
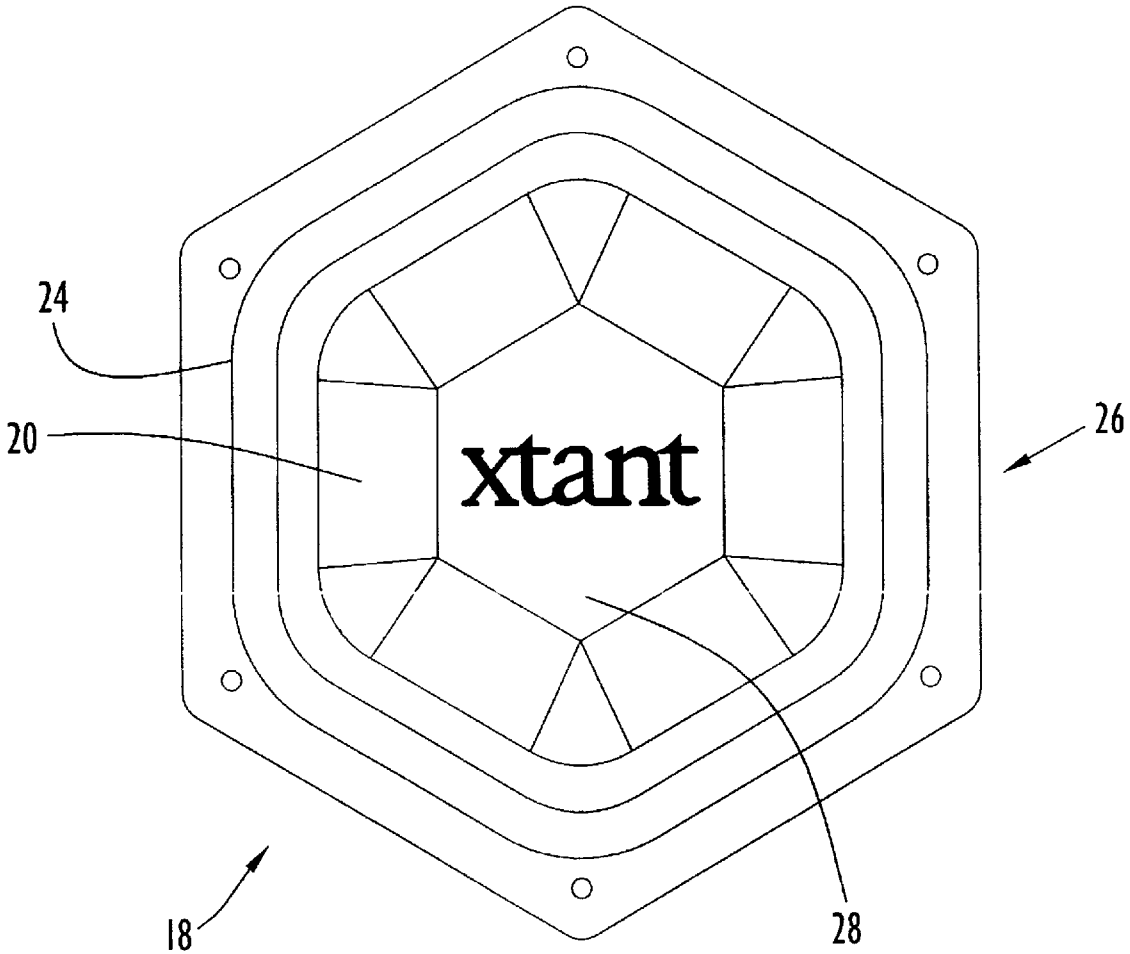
FIG. 3 is a plan view, in elevation, of a hexagonal woofer, in accordance with the present invention.

In the preferred embodiment illustrated in FIGS. 2–9, a nominally 12 inch hexagonal diaphragm 20 has an outer peripheral edge 22 which is substantially hexagonal but includes a faceted, multi planar diaphragm configuration terminating in a substantially circular voice coil support aperture 34 at the back of diaphragm 20. Driver 18 includes a cylindrical voice coil former 36 (e.g., preferably made of Apical® brand plastic film) suspended in an annular gap within the motor structure 30. Voice coil former 36 supports a long-throw voice coil 38. The hexagonal driver 18 of the preferred embodiment preferably includes a hexagonal dust cap 28 covering the support aperture 34 and voice coil former 36. Dust cap 28 is comprised of contiguous substantially planar facets defining six equilateral triangle segments and provides a striking visual effect. Preferably, printed indicia (e.g., "xtant" as seen in FIG. 3) are included on dust cap 28 to provide the purchaser with an attractive visual presentation.

Figure 8:
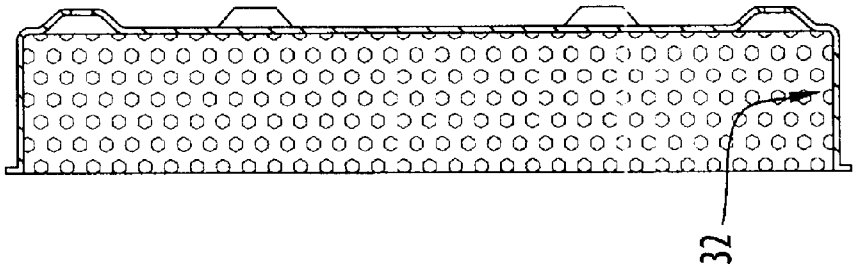
FIG. 8 is a side view, in elevation, of the hexagonal woofer vent screen of FIG. 7, in accordance with the present invention.
Figure 9:
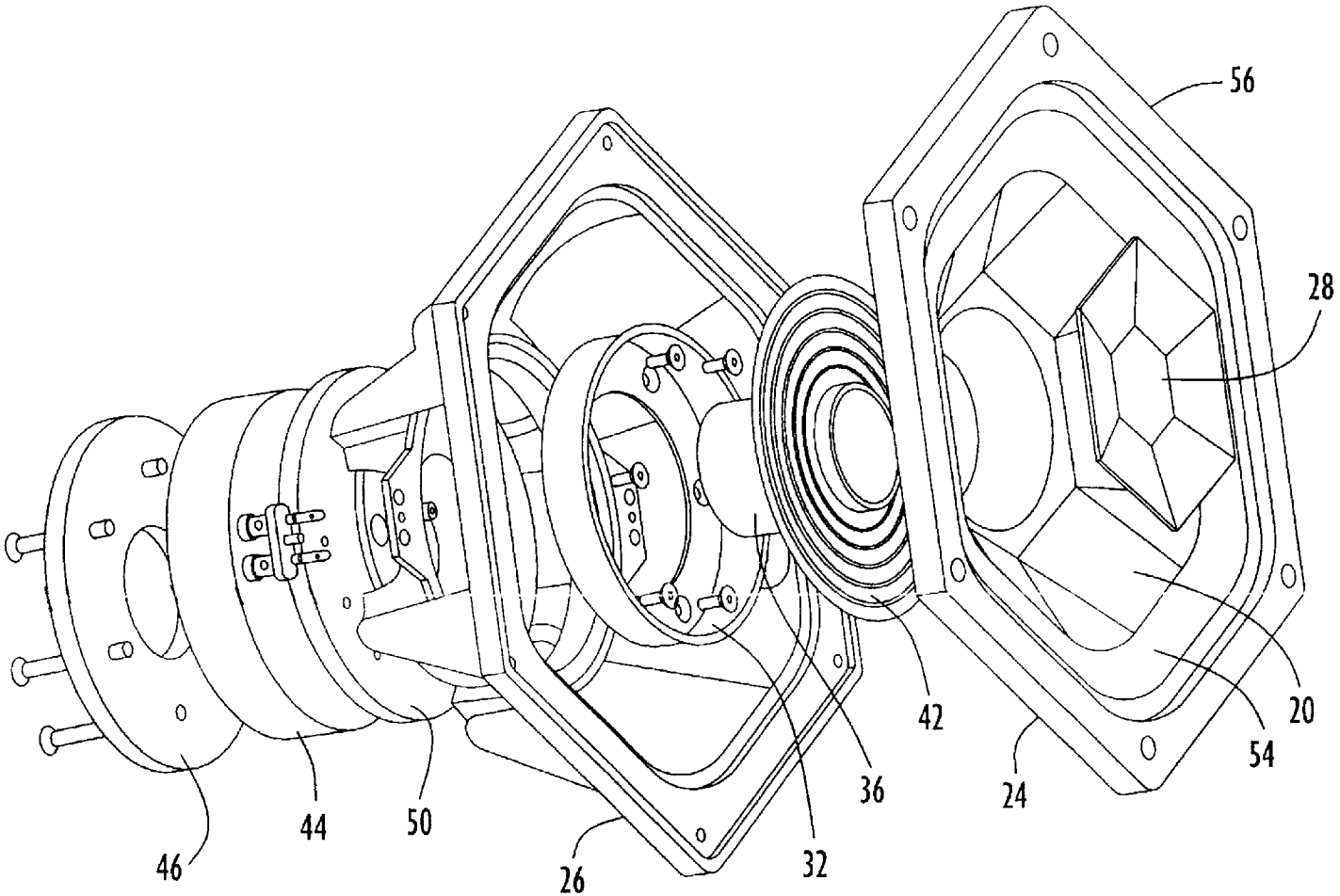
FIG. 9 is an exploded view, in perspective, of a hexagonal woofer driver, in accordance with the present invention.
Figure 10:
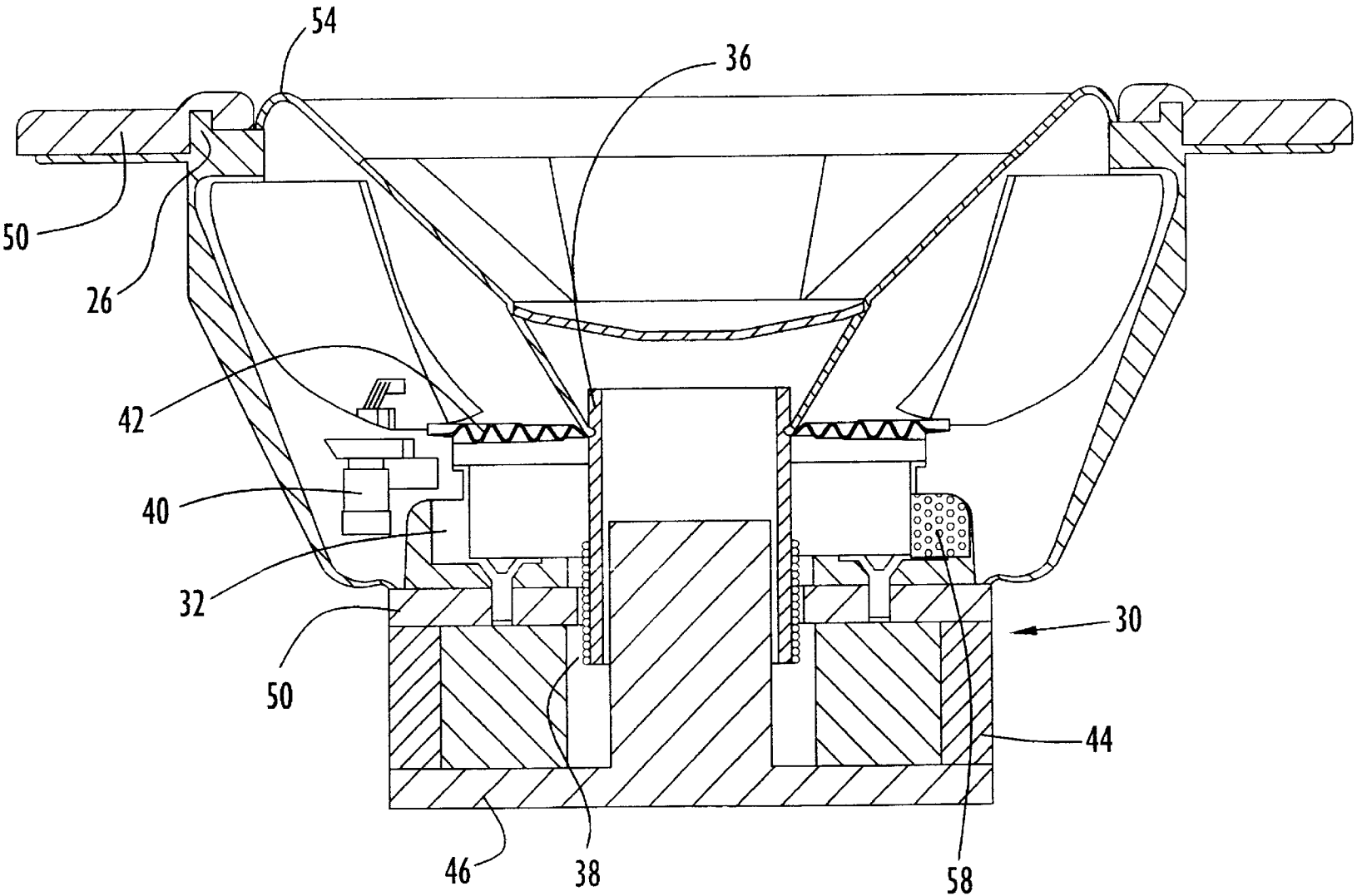
FIG. 10 is a side partial cross-section view, in elevation, of the hexagonal woofer driver of FIG. 9, in accordance with the present invention.

In the preferred embodiment illustrated in FIGS. 2–10, six voice coil cooling vents 58 are arrayed near the front or top plate 50 just beneath the plateau defined by spider 42 in the sidewall of the basket, as best seen in FIG. 10. Cooling vents 58 direct cooling airflow to the voice coil 38 and the annular gap region defined by the pole piece 48 and front plate 50, thereby lowering voice coil temperature during high-power operation. As the diaphragm moves inwardly, air trapped behind the dust cap is pumped back through the voice coil former interior lumen and against the back plate of the T-yoke; the air then travels up past the annular voice coil gap defined between the front plate and the pole piece, and out beneath the spider through the six equally spaced vents 58. As the diaphragm moves outwardly, expanding space behind the dust cap vacuums air through the voice coil former interior lumen after passing the back plate of the T-yoke; the air travels in past the annular voice coil gap defined between the front plate and the pole piece, entering through the six equally spaced vents 58.

Figure 7:
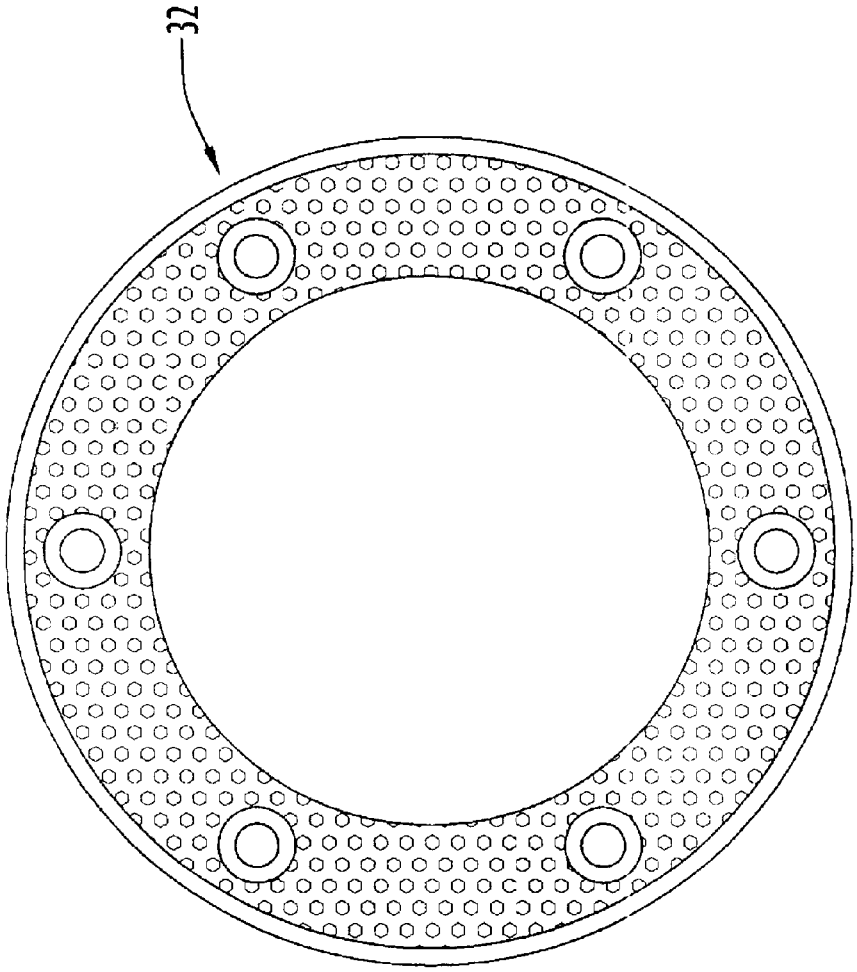
FIG. 7 is a front view, in elevation, of a hexagonal woofer vent screen, in accordance with the present invention.

A venting experiment set forth test results from a number of prototypes and the conclusions were used in selecting locations for venting apertures 58 as shown in the Figures. The presently preferred venting aperture configuration comprises six vent holes 58 arrayed on the basket/motor sidewall along an imaginary circle substantially concentric with voice coil 38 and at a selected diameter and are equally spaced (i.e., at sixty degree intervals). Annular mesh vent screen 32 of FIGS. 7 and 8 is disposed within the basket (adjacent the attaching fasteners attaching the basket to the motor) and filters the incoming cooling air. The illustrated venting aperture configuration demonstrated significant voice coil cooling (i.e., 43.5 degrees centigrade cooler operation @ 400 Watts continuous input for three hours) and provided enhanced long-term, high power reliability.

Figure 4A:
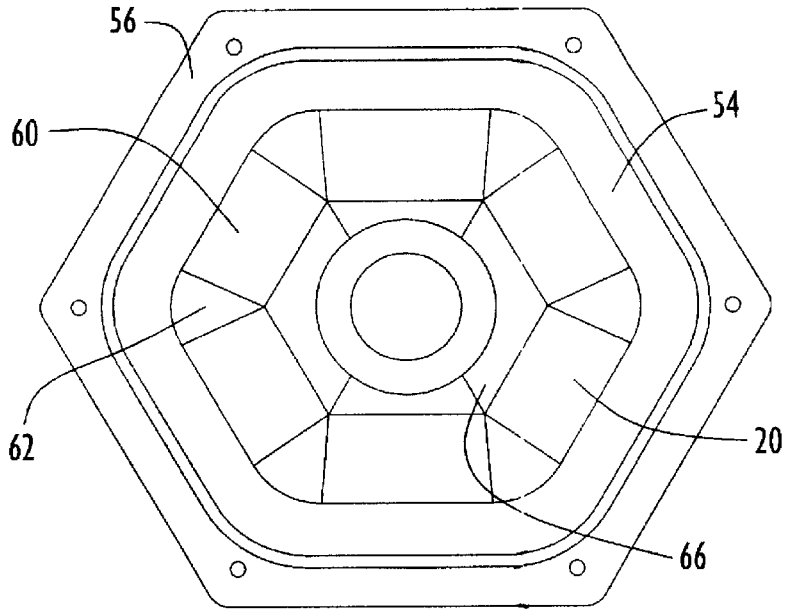
FIG. 4*a* is a front view, in elevation, of a hexagonal woofer diaphragm, in accordance with the present invention.
Figure 4B:
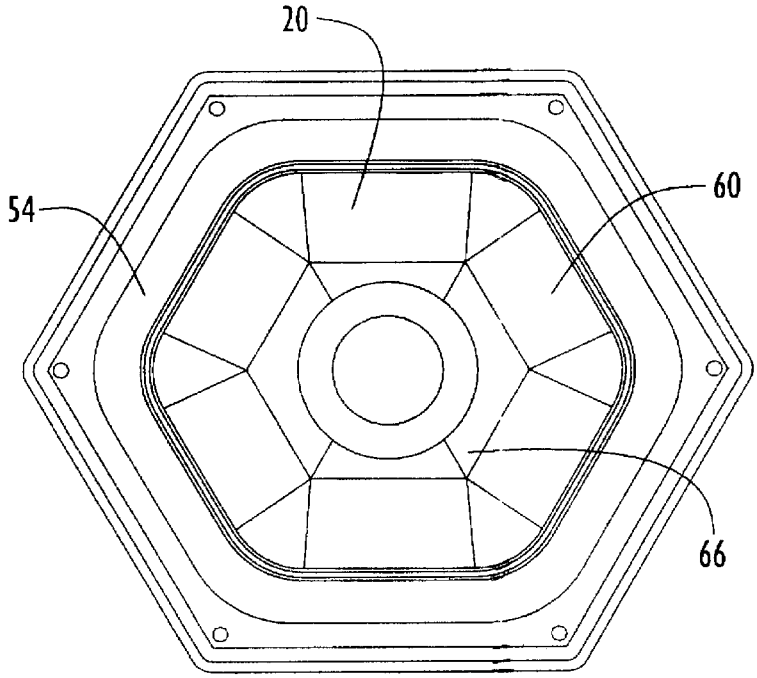
FIG. 4*b* is a rear or back side view, in elevation, of the hexagonal woofer diaphragm of FIG. 4*a*, in accordance with the present invention.
Figure 5A:
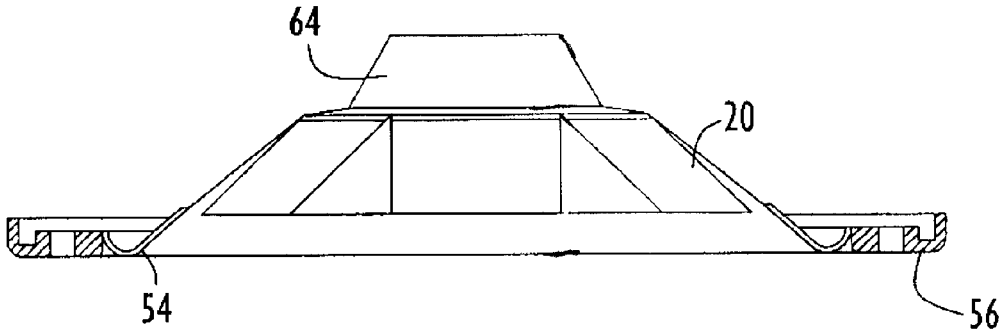
FIG. 5*a* is a side view, in elevation, of a hexagonal woofer diaphragm of FIG. 4*a*, in accordance with the present invention.
Figure 5B:
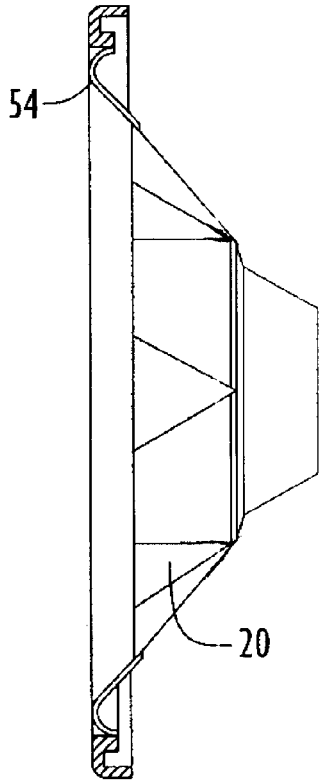
FIG. 5*b* is a side view from a direction orthogonal to the view of FIG. 5*a*, also in elevation, of the hexagonal woofer diaphragm, in accordance with the present invention.

Referring now to FIGS. 4*a*, 4*b*, 5*a*, 5*b* and 9, hexagonal diaphragm 20 has a hexagonal peripheral edge 22 with an integrally molded edge roll surround 54 and an integrally molded one-piece gasket 56. The polygonal configuration of diaphragm 20 includes six rounded or radiused triangular facets 62 alternately disposed between six rectangular and substantially planar facets 60 to provide a substantially hexagonal peripheral edge with rounded or radiused edge segments or corners 24 joining linear peripheral edge segments, thus providing a polygonal faceted diaphragm surface with a substantially hexagonal diaphragm edge 22. The inner edge of the diaphragm defines circular voice coil support aperture 34 which is bounded by a frustoconical transition region 64 that is terminated in a faceted intermediate shoulder 66 having six facets (as best seen in FIGS. 4*a* and 4*b*). The intermediate shoulder 66 is terminated at its interior edge in frustoconical transition region 64 and at its exterior edge in the six planar facets 60, as described above.

Figure 6:
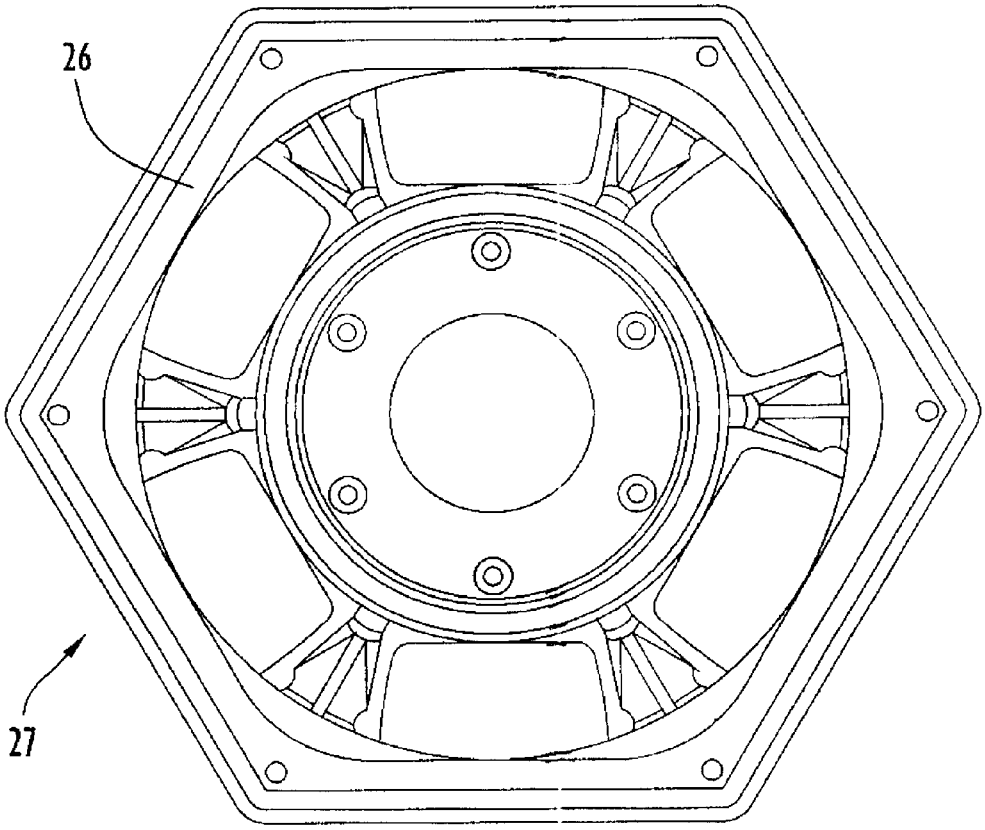
FIG. 6 is a front view, in elevation, of a hexagonal woofer basket, in accordance with the present invention.

As best seen in FIGS. 6 and 9, hexagonal basket 27 carries and movably supports hexagonal diaphragm 20. A Hexagonal section truncated pyramid shaped basket 27 having a hexagonal peripheral mounting flange 26 is dimensioned to fit within and support a matching groove or trough in diaphragm integral gasket 56 (as best seen in the partial cross section view of FIG. 10).

It will be appreciated by persons of ordinary skill in the art that the instant invention makes available a structure and method to pack a plurality of hexagonal woofers 18 in a tight two dimensional array 16 with essentially no wasted interstitial baffle space, since the hexagonal woofer baskets can touch one another. This represents an advance in the state of the art since the faceted hexagonal diaphragm shape provides an increase in cone surface area of approximately ten percent as compared to the conventional frustoconical woofers having round edges of FIG. 1.

In the preferred embodiment of the method of the present invention, a template resembling FIG. 2 but in a 1:1 scale is provided to simplify layout of the woofers on a baffle. The template preferably includes marks designating where apertures in the baffle are to be cut for a tightly packed installation, e.g., as shown in FIG. 2.

A more general method for mounting a plurality of hexagonal basket woofers 18 includes the following method steps:

a) Positioning the plurality of hexagonal basket woofers in a tightly packed two dimensional array, preferably having at least two rows, wherein said hexagonal basket woofers are juxtaposed such that adjacent hexagonal basket periphery surfaces are substantially in contact with one another (e.g., array 16 as shown in FIG. 2);

b) Deriving the dimensions of the required array of (e.g., substantially circular) baffle apertures by measuring the dimensions of the back surface of basket flange 26;

c) Making an aperture in the baffle for each woofer; each aperture is sized to receive the basket wherein the basket back surface abuts the baffle surface; and d) Placing the plurality of hexagonal basket woofers 18 in the apertures to make a tightly packed two dimensional array 16; the hexagonal basket woofers are juxtaposed such that adjacent hexagonal basket periphery surfaces are substantially in contact with one another.

A person of ordinary skill in the art will also recognize that the present invention makes available a voice coil driven low frequency loudspeaker driver 18 having a movable diaphragm surface defining a substantially hexagonal peripheral edge and a central region carrying a voice coil former. The voice coil former is adapted to carry a conductive voice coil having first and second electrical connections 40 and is affixed to the diaphragm proximate the diaphragm central region. Stationary supporting basket structure 27 has a substantially hexagonal outer flange 26 with a hexagonal peripheral edge. A resilient suspension 54, 56 is affixed to the movable diaphragm 20 proximate the diaphragm hexagonal peripheral edge 22 and is affixed to the hexagonal basket proximate basket peripheral edge 26 and movably supports movable diaphragm 20 within the stationary basket structure 27. The diaphragm 20 is preferably a movable hexagonal section truncated pyramid shaped diaphragm and the basket structure is a stationary supporting truncated pyramid shaped basket structure 27 dimensioned to receive and movably support the movable hexagonal section truncated pyramid shaped diaphragm 20.

The resilient suspension is preferably a substantially hexagonal edge roll 54 integrally molded from an elastomer, plastic or rubber in situ on the substantially hexagonal diaphragm peripheral edge 22, and a substantially hexagonal gasket 56 is preferably dimensioned to cover the substantially hexagonal basket flange edge, gasket 56 is preferably integrally molded in situ contiguously with edge roll 54 and is carried on the diaphragm peripheral edge.

The diaphragm comprises a movable hexagonal section truncated pyramid shaped diaphragm including six substantially planar diaphragm facets or segments 60, and the substantially planar diaphragm segments are connected to one another and bounded by six interspersed triangular curved surfaces defining a radiused peripheral edge connecting the six straight sides of said substantially hexagonal diaphragm peripheral edge 22. The substantially planar diaphragm segments 60 are connected to a frustoconical transition segment 64 having an inner circular voice coil former supporting edge which defines an aperture 34.

Having described preferred embodiments of a new and improved woofer and mounting method, it is believed that other modifications, variations and changes will be suggested to those skilled in the art in view of the teachings set forth herein. It is therefore to be understood that all such variations, modifications and changes are believed to fall within the scope of the present invention as defined by the appended claims.

What is claimed is:

1. A voice coil driven low frequency loudspeaker driver, comprising:

a movable diaphragm having diaphragm surface defining a substantially hexagonal peripheral edge and a central region carrying in a voice coil former;

a voice coil former adapted to carry a conductive voice coil having first and second electrical connections; said voice coil former being affixed to said diaphragm proximate said central region;

a stationary supporting basket structure having a substantially hexagonal outer flange with a hexagonal peripheral edge;

a resilient suspension being affixed to said movable diaphragm proximate said diaphragm hexagonal peripheral edge and being affixed to said hexagonal basket proximate said basket peripheral edge and movably supporting said movable diaphragm within said stationary basket structure.

2. The voice coil driven low frequency loudspeaker driver of claim 1, wherein said diaphragm comprises a movable hexagonal section truncated pyramid shaped diaphragm.

3. The voice coil driven low frequency loudspeaker driver of claim 2, wherein said basket structure comprises a stationary supporting truncated pyramid shaped basket structure dimensioned to receive and movably support said movable hexagonal section truncated pyramid shaped diaphragm.

4. The voice coil driven low frequency loudspeaker driver of claim 3, wherein said resilient suspension comprises a substantially hexagonal edge roll integrally molded in situ on said substantially hexagonal diaphragm peripheral edge.

5. The voice coil driven low frequency loudspeaker driver of claim 4, wherein said resilient suspension further comprises a substantially hexagonal gasket dimensioned to cover said substantially hexagonal basket flange edge, said gasket being integrally molded in situ proximate said edge roll on said diaphragm peripheral edge.

6. The voice coil driven low frequency loudspeaker driver of claim 3, wherein said resilient suspension comprises a substantially hexagonal gasket dimensioned to cover said substantially hexagonal basket flange edge said gasket being integrally molded in situ and carried on said diaphragm peripheral edge.

7. The voice coil driven low frequency loudspeaker driver of claim 1, wherein said diaphragm comprises a movable hexagonal section truncated pyramid shaped diaphragm including six substantially planar diaphragm segments.

8. The voice coil driven low frequency loudspeaker driver of claim 7, wherein said substantially planar diaphragm segments are connected to one another and bounded by six interspersed triangular curved surfaces defining a radiused peripheral edge connecting the six straight sides of said substantially hexagonal diaphragm peripheral edge.

9. The voice coil driven low frequency loudspeaker driver of claim 7, wherein said substantially planar diaphragm segments are connected to a frustoconical transition segment having an inner circular voice coil former supporting edge.

10. A voice coil driven low frequency loudspeaker driver, comprising:

a movable diaphragm comprising a plurality of substantially planar polygonal diaphragm surfaces defining a polygonal peripheral edge and terminating in an interior edge defining a substantially circular aperture;

a stationary supporting frustoconical basket structure having a polygonal peripheral edge;

a resilient suspension supporting said movable diaphragm within said stationary basket structure.

11. The voice coil driven low frequency loudspeaker driver of claim 10, wherein said diaphragm polygonal peripheral edge is a hexagonal edge having six linear sides joined in radiused corners.

12. The voice coil driven low frequency loudspeaker driver of claim 11, wherein said basket structure polygonal peripheral edge is a hexagonal edge having six linear sides joined in radiused corners.

13. A method for mounting a plurality of hexagonal basket woofers on a substantially planar baffle surface, comprising the steps of:

a) positioning the plurality of hexagonal basket woofers in a tightly packed two dimensional array having at least two rows, wherein said hexagonal basket woofers are juxtaposed such that adjacent hexagonal basket periphery surfaces are substantially in contact with one another;

b) deriving the dimensions of an optimum array of substantially circular baffle apertures by measuring the radius of an imaginary circle defining the circular inside profile of the basket flange back surface;

c) making a substantially circular aperture in the baffle for each woofer; said aperture sized to receive the basket wherein the basket back surface abuts the baffle surface;

d) placing the plurality of hexagonal basket woofers in the apertures to make a tightly packed two dimensional array having at least two rows, wherein said hexagonal basket woofers are juxtaposed such that adjacent hexagonal basket periphery surfaces are substantially in contact with one another.

* * * * *